US010222718B2

(12) United States Patent
Okayasu et al.

(10) Patent No.: US 10,222,718 B2
(45) Date of Patent: Mar. 5, 2019

(54) IMAGE FORMING APPARATUS FOR DUPLEX OPERATION USING POTENTIAL DIFFERENCES

(71) Applicant: CANON KABUSHIKI KAISHA, Tokyo (JP)

(72) Inventors: Kohei Okayasu, Mishima (JP); Masashi Tanaka, Kawasaki (JP); Sho Taguchi, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/605,807

(22) Filed: May 25, 2017

(65) Prior Publication Data

US 2017/0343918 A1 Nov. 30, 2017

(30) Foreign Application Priority Data

May 31, 2016 (JP) ..... 2016-109284

(51) Int. Cl.
*G03G 15/02* (2006.01)
*G03G 15/23* (2006.01)
*G03G 15/00* (2006.01)

(52) U.S. Cl.
CPC ..... *G03G 15/0266* (2013.01); *G03G 15/235* (2013.01); *G03G 15/6558* (2013.01)

(58) Field of Classification Search
CPC ..... G03G 15/0266
USPC ..... 399/50
See application file for complete search history.

(56) References Cited

U.S. PATENT DOCUMENTS 6,205,300 B1 * 3/2001 Sakai ..... G03G 15/165 399/315
2009/0297182 A1 * 12/2009 Kinukawa ..... G03G 15/0266 399/43
2012/0328314 A1 * 12/2012 Sugimoto ..... G03G 15/1605 399/66

FOREIGN PATENT DOCUMENTS

JP 4-186386 A 7/1992
JP 5-313518 A 11/1993
JP 7-239617 A 9/1995
JP 11-24431 A 1/1999
JP 2004-13032 A 1/2004

* cited by examiner

*Primary Examiner* — Walter L Lindsay, Jr.
*Assistant Examiner* — Philipmarcus T Fadul
(74) *Attorney, Agent, or Firm* — Canon U.S.A., Inc. IP Division

(57) ABSTRACT

In a configuration in which a voltage of polarity opposite to charging polarity of toner is applied to a conveyance guide, controlling deposition of toner on the conveyance guide has been difficult. When performing duplex image formation, a potential difference between a surface potential of a photoconductive drum charged by a charging roller and a potential of the conveyance guide is smaller during printing on the second surface than during printing on the first surface.

11 Claims, 6 Drawing Sheets

IMAGE FORMING APPARATUS FOR DUPLEX OPERATION USING POTENTIAL DIFFERENCES

BACKGROUND OF THE INVENTION

Field of the Invention

The disclosure relates to an image forming apparatus which forms an image in an electrophotographic process, such as a copier, a printer, a facsimile machine, and a multifunction apparatus.

Description of the Related Art

In an image forming apparatus employing an electrophotographic process, an electrostatic latent image is formed on a photoconductor which is uniformly charged and then exposed in accordance with image information. The electrostatic latent image is developed as a toner image using toner and then transferred to a recording material, such as a recording sheet, by a transfer member. Then, the toner image transferred to the recording material is fixed with heat to the recording material by a fixing unit.

An image forming apparatus provided with a guidance member for guiding a posture of a recording material at a position upstream of a transfer portion in a conveyance direction of the recording material in order to convey the recording material to a transfer portion constituted by a transfer member and a photoconductor has been proposed. As an image forming apparatus provided with a conveyance guide as such a guidance member, Japanese Patent Laid-Open No. 7-239617 discloses an image forming apparatus which applies a voltage of polarity opposite to charging polarity of toner to a conveyance guide. A leakage of a transfer current from the transfer member through the recording material can be prevented by applying a voltage of polarity opposite to charging polarity of toner to the conveyance guide.

When duplex printing is performed in an image forming apparatus capable of performing duplex printing, a recording material with a toner image fixed to a first surface thereof is brought into contact with a conveyance guide and then again conveyed to a transfer portion. Since a voltage of polarity opposite to charging polarity of toner is applied to the conveyance guide, a part of a toner image fixed to a first surface of the recording material may sometimes adhere to the conveyance guide. This is because there is a limited amount of toner that is not completely fixed to the recording material in the toner image fixed to the first surface of the recording material. An amount of toner adhering to the conveyance guide from each sheet is very small, but an amount of toner depositing in the conveyance guide increases as the number of sheets increases, which may cause soiling of the recording material.

SUMMARY OF THE INVENTION

The present disclosure prevents deposition of toner in a guidance member in a configuration which applies a voltage of polarity opposite to charging polarity of toner to the guidance member.

In an aspect of the present disclosure, an image forming apparatus, includes a photoconductor on which an electrostatic latent image is formed, a charging member configured to charge the photoconductor, a developing member configured to develop the electrostatic latent image formed on the photoconductor with toner charged to predetermined polarity, a transfer member configured to form a transfer portion together with the photoconductor and to transfer a toner image from the photoconductor to a recording material in the transfer portion, a transfer power source configured to apply a voltage of polarity opposite to the predetermined polarity to the transfer member, a guidance member provided upstream of the transfer portion in a conveyance direction of the recording material, and configured to guide the recording material in contact with a back surface of the conveyed recording material, an auxiliary power source configured to apply a voltage of the opposite polarity to the guidance member, a fixing unit configured to fix the toner image transferred from the photoconductor to the recording material, and a control unit configured to control a potential difference between a surface potential of the photoconductor charged by the charging member and a potential of the guidance member. The image forming apparatus is capable of performing duplex image formation by turning over the recording material in which the toner image is fixed to a first surface by the fixing unit, conveying the recording material to the transfer portion, and transferring the toner image from the photoconductor to a second surface. When performing the duplex image formation, the control unit controls a potential difference between a surface potential of the photoconductor charged by the charging member and a potential of the guidance member to be smaller during printing on the second surface than during printing on the first surface.

Further features of the present disclosure will become apparent from the following description of exemplary embodiments with reference to the attached drawings.

DESCRIPTION OF THE EMBODIMENTS

Hereinafter, preferred embodiments of the disclosure are described in detail with reference to the drawings. Dimensions, materials, shapes, relative positions, etc. of components described in the embodiments are subject to change depending on configurations and various conditions of apparatuses to which the disclosure is applied, and the scope of the disclosure is not limited to the following embodiments.

First Embodiment

Figure 1:
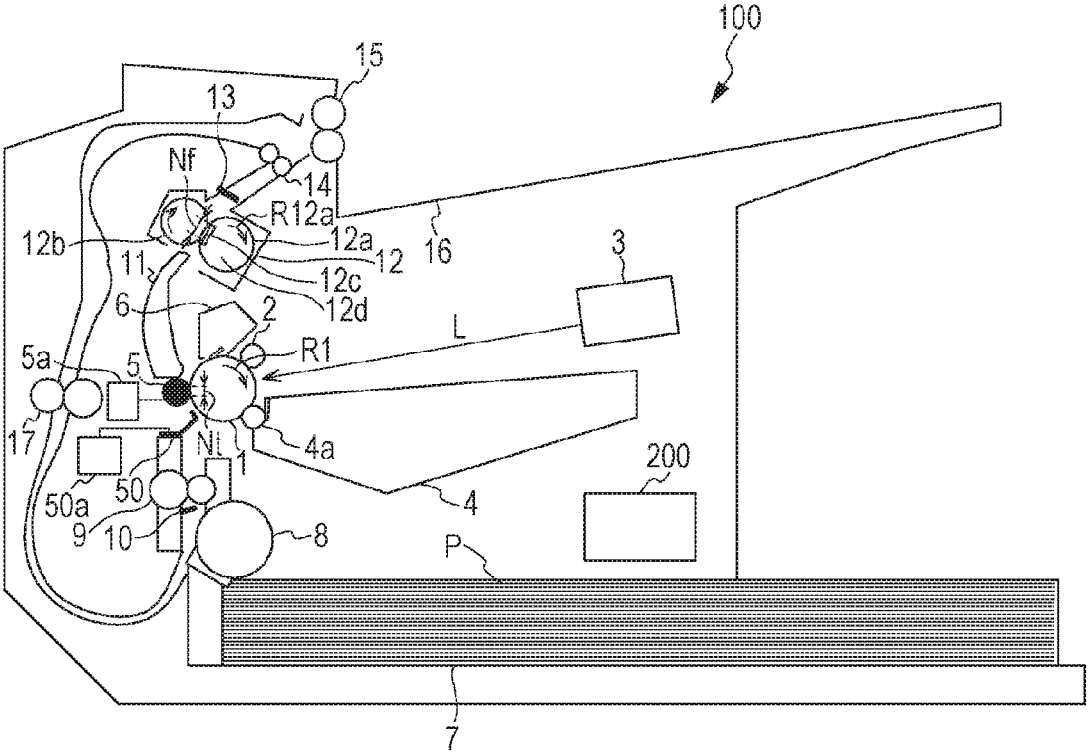
FIG. 1 is a schematic cross-sectional view of an image forming apparatus according to a first embodiment.

FIG. 1 is a schematic cross-sectional view of an image forming apparatus 100 according to a first embodiment. The image forming apparatus 100 according to the present embodiment is a laser printer employing an electrophotographic system.

The image forming apparatus 100 includes a drum-shaped electrophotographic photoconductor 1 as an image bearing member (hereinafter a "photoconductive drum"). The photoconductive drum 1 is constituted by a photosensitive material, such as an organic optical semiconductor (OPC), amorphous selenium, and amorphous silicon, provided on a cylindrical drum base made of aluminum, nickel, etc. The photoconductive drum 1 is rotatably supported by an apparatus main body of the image forming apparatus 100, and is rotated at a predetermined process speed in a direction of arrow R1 by an unillustrated driving source.

A charging member (a charging roller) 2, an exposure unit (a scanner) 3, a development unit 4, a transfer member (a transfer roller) 5, and a cleaning unit 6 are disposed around the photoconductive drum 1 in this order along a rotational direction of the photoconductive drum 1. A sheet feed cassette 7 accommodating recording materials P, such as paper, is disposed at a lower portion of the image forming apparatus 100. A feed roller 8, a conveyance roller pair 9, a top sensor 10, and a conveyance guide 50 are disposed in this order along a conveyance path of the recording material P.

A post-transfer guide 11, a fixing unit 12, an discharge sensor 13, a conveyance roller 14, a discharge roller 15, and a discharge tray 16 are disposed downstream of a transfer portion Nt constituted by the transfer roller 5 and the photoconductive drum 1 in a conveyance direction of the recording material P. In the present embodiment, the photoconductive drum 1, the charging roller 2 and the developing unit 4 are integrated as a unit and are removably attached to the apparatus main body.

Next, a process operation of the thus-configured image forming apparatus is described. The photoconductive drum 1 driven to rotate in the direction of arrow R1 by the unillustrated driving source is rotated at a process speed (a circumferential speed) of 230 mm/s. The photoconductive drum 1 is charged substantially uniformly of predetermined (in the present embodiment, negative) polarity to a predetermined potential (in the present embodiment, −800V) by the charging roller 2. A surface of the charged photoconductive drum 1 is subject to image exposure L in accordance with image information by a scanner 3, whereby charge is removed in the exposed portion and an electrostatic latent image is formed. The electrostatic latent image formed on the photoconductive drum 1 is developed by the development unit 4. The development unit 4 includes a developing roller 4*a* which is a developing member. The development unit 4 applies a negative developing voltage to the developing roller 4*a*, and makes toner adhere to the electrostatic latent image on the photoconductive drum 1 so that the electrostatic latent image is developed as a toner image.

The toner image developed on the photoconductive drum 1 is transferred to the recording material P by the transfer roller 5 in the transfer portion Nt. The transfer roller 5 is pressed against the photoconductive drum 1 by an unillustrated pressurizing spring. The cleaning unit 6 removes toner remaining on the photoconductive drum 1 after the toner image is transferred to the recording material P.

The recording material P is accommodated in the sheet feed cassette 7 and is fed one at a time by the feed roller 8. A leading end of the fed recording material P is detected by the top sensor 10, and the recording material P is conveyed by the conveyance roller pair 9 in synchronization with the toner image on the photoconductive drum 1. The recording material P is conveyed to the transfer portion Nt between the photoconductive drum 1 and the transfer roller 5 while being guided on a back surface by the conveyance guide 50 which is a guidance member. A transfer voltage of polarity opposite to charging polarity of toner is applied to the transfer roller 5 by a transfer power source 5*a*, and, therefore, the toner image on the photoconductive drum 1 is transferred to a surface of the recording material P. Here, a voltage of 1500 V is applied as the transfer voltage.

The recording material P bearing the transferred toner image is conveyed along the post-transfer guide 11 to the fixing unit 12, where an unfixed toner image is fixed to the surface of the recording material P with heat and pressure. The fixing unit 12 is a fixing device which uses a flexible endless belt as a fixing film and drives a pressure roller. The fixing unit 12 includes a fixing film 12*a* which is a film-shaped fixing rotor, and a pressure roller 12*b* as a pressure member pressed against the fixing film 12*a*. The fixing unit 12 further includes a ceramic heater (hereinafter, a heater) 12*c* which heats the toner via the fixing film 12*a*, and a heater holder 12*d* which is a heater support member.

The pressure roller 12*b* is formed by providing an elastic heat-resistant layer made of silicone rubber, etc. on an outer peripheral surface of a core metal, and providing a highly releasable releasing layer made of fluororesin, etc. as an outermost layer. The pressure roller 12*b* presses the fixing film 12*a* against the heater 12*c* from below on an outer surface of the releasing layer by an unillustrated pressurizing spring, and forms a fixing portion Nf between the pressure roller 12*b* and the fixing film 12*a*. Rotational force acts on the fixing film 12*a* by pressure contact frictional force in the fixing portion Nf between the pressure roller 12*b* and the fixing film 12*a* so that the fixing film 12*a* is driven to rotate in a direction of arrow R12*a* while an inner surface of the fixing film 12*a* is in close contact with and sliding against a lower surface of the heater 12*c*. When the pressure roller 12*b* is driven to rotate, the fixing film 12*a* is rotated to follow the rotation. In a state where electric power is supplied to the heater 12*c*, the heater 12*c* is heated to a predetermined temperature, and temperature control is performed, the recording material P bearing the toner image is introduced between the fixing film 12*a* and the pressure roller 12*b* in the fixing portion Nf. In the fixing portion Nf, the recording material P is pinched and conveyed through a fixing nip portion N together with the fixing film 12*a* with a surface of the recording material P on which the toner image is born being in close contact with an outer surface of the fixing film 12*a*. In this pinching and conveyance process, heat of the heater 12*c* is applied to the recording material P via the fixing film 12*a*, an unfixed toner image on the recording material P is fused and fixed to the recording material P with heat and pressure.

The recording material P which passed through the fixing portion Nf is curvature-separated from the fixing film 12*a*.

If an image is formed only on a first surface (a front surface) of the recording material P (hereinafter, "single-sided image formation"), the recording material P is conveyed by the conveyance roller 14 after passing through the discharge sensor 13 and is discharged on the discharge tray 16 by the discharge roller 15.

The image forming apparatus 100 includes a CPU 200 as a control unit on which an electric circuit for executing various control is mounted. The CPU 200 can control a driving source (not illustrated) about the conveyance of the recording material P and image formation, and can control the transfer power source 5*a* and an auxiliary power source 50*a*.

The image formation apparatus 100 according to the present embodiment can perform duplex image formation by turning over the recording material P in which a toner image is fixed to the first surface (the front surface) by the fixing unit 12, conveying the recording material P to the transfer portion Nt, and transferring a toner image from the photoconductive drum 1 to a second surface (a back surface) of the recording material P.

Figure 2A:
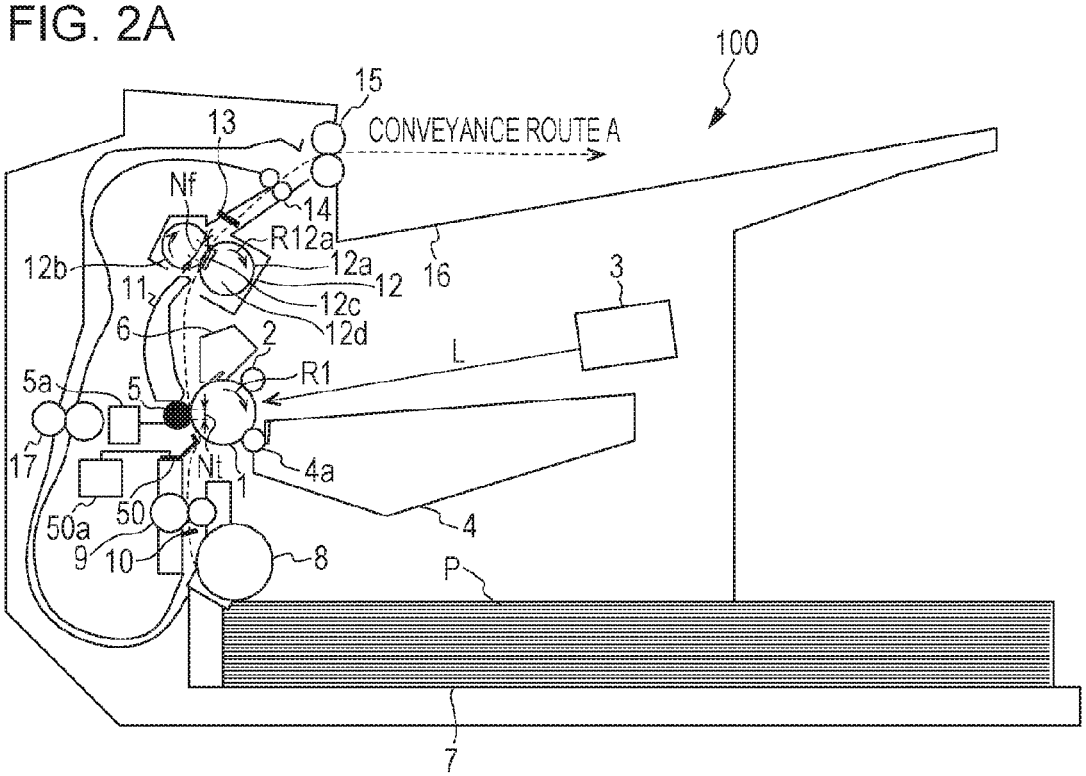
FIG. 2A illustrates a conveyance route which is a conveyance route of a recording material during single-sided image formation.

Duplex image formation is described in detail with reference to FIGS. 2A and 2B. FIG. 2A illustrates a conveyance route A which is a conveyance route of the recording material P for single-sided image formation. When single-sided image formation is performed, as illustrated in FIG. 2A, the recording material P after passing through the fixing unit 12 passes the discharge roller 15 and is discharged on the discharge tray 16.

Figure 2B:
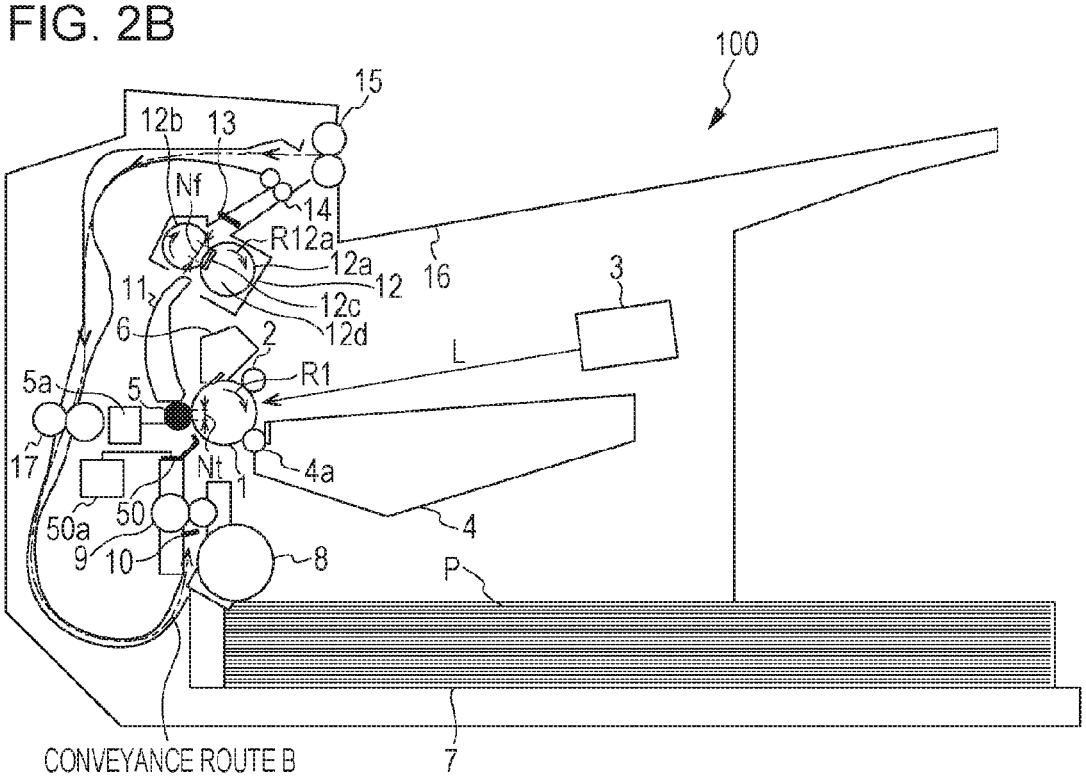
FIG. 2B illustrates a conveyance route which is a conveyance route of the recording material during duplex image formation.

FIG. 2B illustrates a conveyance route B which is a conveyance route of the recording material P for duplex image formation. If duplex image formation is performed, when the discharge sensor 13 detects a trailing end of the recording material P after the transfer process and the fixing process on the first surface of the recording material P are finished, the discharge roller 15 turns in the opposite direction at predetermined timing and draws the recording material P inside of the image forming apparatus 100 again. The recording material P is conveyed along the conveyance route B by a duplex conveyance roller 17. When the top sensor 10 detects the leading end of the recording material P again, image formation on the second surface is performed. Subsequent operation of the image formation on the second surface is the same as that on the first surface, and the recording material P in which the toner image is fixed to the second surface is discharged on the discharge tray 16 from the discharge roller 15.

Figure 3:
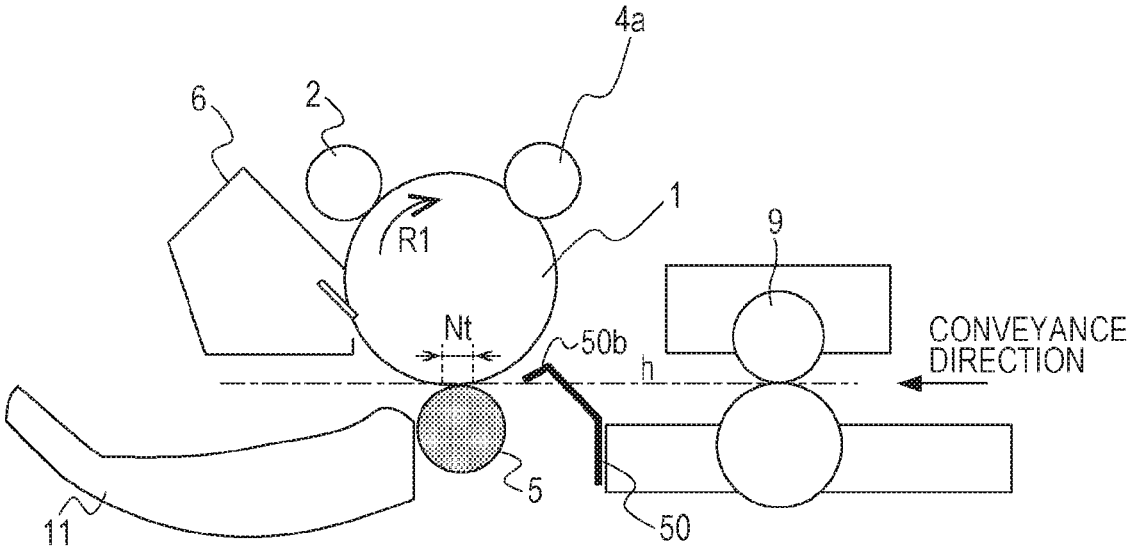
FIG. 3 schematically illustrates a position at which a conveyance guide is disposed.

Next, a reason for which a voltage is applied to the conveyance guide 50 from the auxiliary power source 50*a* is described with reference to FIG. 3. FIG. 3 schematically illustrates a position at which the conveyance guide 50 is disposed. The auxiliary power source 50*a* applies a voltage of polarity opposite to charging polarity of toner (in the present embodiment, positive polarity) to the conveyance guide 50. As illustrated in FIG. 3, the conveyance guide 50 is disposed near the transfer portion Nt and upstream of the recording material P in the conveyance direction in order to guide the recording material P conveyed by the conveyance roller pair 9 to the transfer portion Nt. A part of the conveyance guide 50 protrudes above a line h which connects the transfer portion Nt and a conveyance portion of the conveyance roller pair 9 (on the photoconductor side). The conveyance guide 50 further includes an opposed surface 50*b* which faces the photoconductive drum 1. With the opposed surface 50*b*, the conveyance guide 50 can guide the recording material P to a desired area.

Figure 4:
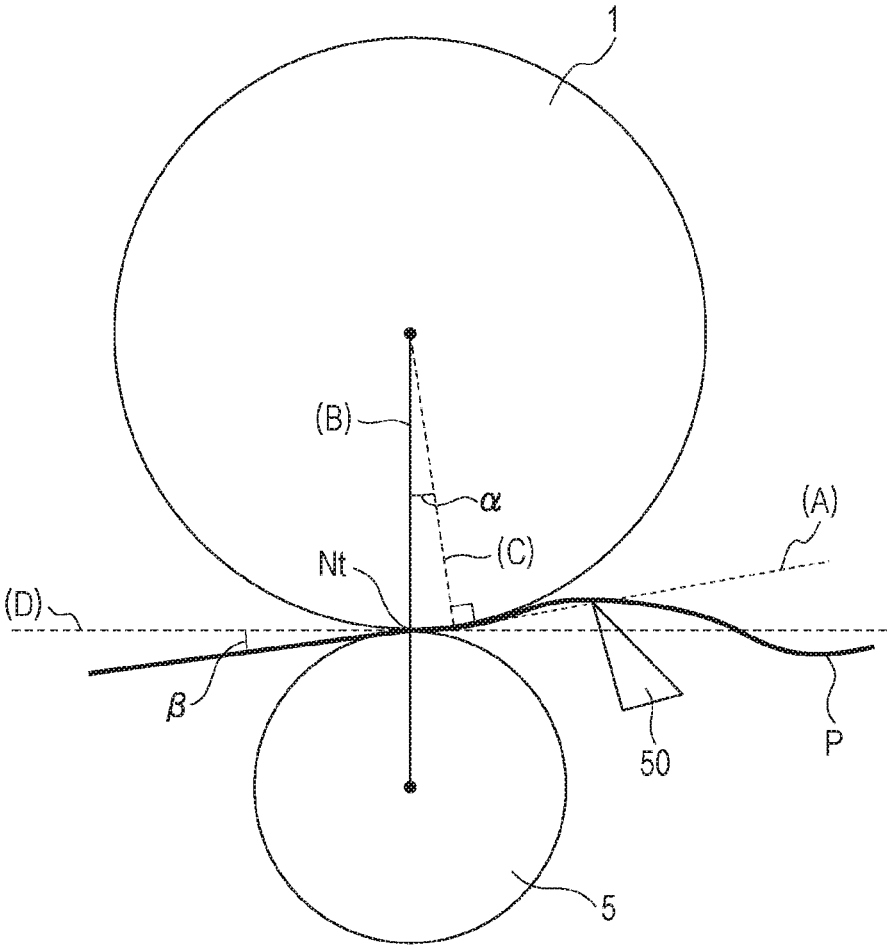
FIG. 4 is an enlarged schematic view of a portion near a transfer portion constituted by a photoconductive drum and a transfer roller.

A protrusion position of the conveyance guide 50 is described in detail with reference to FIG. 4. FIG. 4 illustrates the transfer portion Nt between the photoconductive drum 1 and the transfer roller 5 according to the first embodiment. FIG. 4 schematically illustrates an angle at which the recording material P is wound around the photoconductive drum 1 while being conveyed in the transfer portion Nt (a winding angle $\alpha$) and a transfer separation angle $\beta$.

As illustrated in FIG. 4, the recording material P conveyed by the conveyance roller pair 9 is conveyed to the transfer portion Nt while being guided by the conveyance guide 50. Specifically, the recording material P is conveyed to the transfer portion Nt from a position closer to the photoconductive drum 1 than the transfer roller 5. Here, a tangent which passes an apex of the conveyance guide 50 among tangents touching the outer peripheral surface of the photoconductive drum 1 is defined as a straight line A as a first line, and a line segment connecting the center of the photoconductive drum 1 and the center of the transfer roller 5 is defined as a line segment B as a second line. Specifically, the straight line A is the tangent of which a contact point with the photoconductive drum 1 is closer to the transfer portion Nt among other tangents touching the outer peripheral surface of the photoconductive drum 1 from a portion closest to the transfer portion Nt in the portion in which the conveyance guide 50 and the recording material P are in contact with each other. A line segment extending from a contact point between the outer peripheral surface of the photoconductive drum 1 and the straight line A to the center of the photoconductive drum 1 is defined as a line segment C as a third line. An angle made by the line segment B and the line segment C is defined as a winding angle $\alpha$.

If the line segment C is located upstream of the line segment B in the rotational direction of the photoconductive drum 1, the winding angle $\alpha$ shall be positive. That is, if the line segment C is located downstream of the line segment B in the rotational direction of the photoconductive drum 1, the winding angle $\alpha$ shall be negative. A tangent which passes through the center of the transfer portion Nt and which orthogonally crosses the line segment B among the tangents touching the outer peripheral surface of the photoconductive drum 1 is defined as a transfer nip line D. In the present embodiment, the transfer nip line D and the line h illustrated in FIG. 3 are common lines. As described above, by disposing an end of the conveyance guide 50, the recording material P is conveyed to be in contact with the photoconductive drum 1 at a position upstream of the transfer portion Nt by the conveyance guide 50.

The conveyance guide 50 is entirely or partially made of an electroconductive member, such as iron or stainless steel (SUS), to prevent triboelectric charging caused by rubbing with the recording material P. If the conveyance guide 50 is made of an electroconductive member, there is a case where a current flows from the transfer roller 5 through the recording material P when the recording material P reaches the transfer portion Nt, and an amount of current (a transfer current) which flows toward the photoconductive drum 1 in the transfer portion Nt decreases. A decrease in the amount of the transfer current may reduce a transfer efficiency. This phenomenon tends to occur when the recording material P has low resistance. Then, in the present embodiment, a leakage of the current from the transfer roller 5 through the recording material P is prevented by applying a positive voltage to the conveyance guide 50.

The optimal voltage value applied to the conveyance guide 50 from the auxiliary power source 50*a* changes depending on charging characteristics of toner and latent image setting of the photoconductive drum 1. In the present embodiment, a voltage in a range from 300 V to 500 V of the same polarity as and is smaller in an absolute value than the voltage applied by the transfer power source 5*a* can be applied, and a voltage of 300 V is applied. The photoconductive drum 1 is uniformly charged to a potential of predetermined polarity (Vd) by the charging roller 2. Since Vd is −800V in the present embodiment, a potential difference of −1100 V is made between the conveyance guide 50 and the photoconductive drum 1.

If a potential difference of 1100 V is always made between the conveyance guide 50 and the photoconductive drum 1 during duplex image formation, a part of the toner image fixed to the first surface of the recording material P may adhere to the conveyance guide 50. Since a part of the toner image fixed to the first surface of the recording material P has charge even after fixing, the toner is attracted to the conveyance guide 50 due to the potential difference between the conveyance guide 50 and the photoconductive drum 1. Toner tends to move especially in patterns with isolated dots, such as halftone images. The more densely printing is performed on the first surface, the greater amount of toner moves and, as the number of fed paper sheets increases, toner deposits on the conveyance guide 50. When the toner deposits on the conveyance guide 50, toner soiling of the recording material P occurs. As illustrated in FIG. 3, since the conveyance guide 50 includes the opposed surface 50*b*, toner deposition easily occurs in this configuration.

In the present embodiment, during performing duplex image formation, a potential difference between a surface potential of the photoconductive drum 1 charged by a charging roller 2 and a potential of the conveyance guide 50 is smaller during printing on the second surface (a second potential difference) than during printing on the first surface (a first potential difference). Specifically, the first potential difference is defined as 1100 V as described above, and the second potential difference is defined as 750 V. The second potential difference is made by defining the potential of the charged photoconductive drum 1 as −750 V and turning a voltage applied to the conveyance guide 50 off (0 V). A reason for which the voltage applied to the conveyance guide 50 can be turned off when the toner image is transferred from the photoconductive drum 1 during printing on the second surface during duplex image formation is that the transfer current does not easily leak from the transfer roller 5.

Since resistance of the recording material P which once passed through the fixing unit 12 is high enough, a current does not easily flow toward the conveyance guide 50. Therefore, the voltage applied to the conveyance guide 50 can be lowered to prevent adhesion of toner during duplex image formation. Although a voltage applied to the conveyance guide 50 from the auxiliary power source 50*a* during duplex image formation is turned off (stopped) in the present embodiment, a voltage smaller than the voltage applied during single-sided image formation may be applied to the conveyance guide 50 in a range in which adhesion of toner can be prevented.

Effects of the present embodiment are confirmed in an experiment. As the recording material P, letter-size Business 4200 manufactured by Xerox Corporation (hereinafter, "Letter paper") is used. Letter paper left for 48 hours under a high-humidity/high-temperature environment (80%/32.5° C.) is prepared as the recording material P, and halftone images are printed on 100 sheets at a printing ratio of 30% as duplex image formation.

As a Comparative Example 1, a configuration in which a potential difference between the potential of the photoconductive drum 1 and the potential of the conveyance guide 50 is not changed during printing on the first surface and during printing on the second surface is prepared, and the same experiment as that of the present embodiment is performed. In the following Table, a potential of the photoconductive drum 1 charged by the charging roller 2 is defined as Vd, and a potential of the conveyance guide 50 is defined as Vg.

TABLE

| | FIRST SURFACE | | | SECOND SURFACE | | | DIFFERENCE BETWEEN POTENTIAL DIFFERENCES BETWEEN FIRST SURFACE AND SECOND SURFACE | SOILING OF CONVEYANCE GUIDE |
|---|---|---|---|---|---|---|---|---|
| | Vd | Vg | POTENTIAL DIFFERENCE | Vd | Vg | POTENTIAL DIFFERENCE | | |
| COMPARATIVE EXAMPLE 1 | −800 | +300 | 1100 | −800 | +300 | 1100 | 0 | OCCUR |
| FIRST EMBODIMENT | −800 | +300 | 1100 | −750 | 0 | 750 | 350 | NOT OCCUR |

In Comparative Example 1, since the potential difference between the potential of the photoconductive drum 1 and the potential of the conveyance guide 50 is not changed during printing on the first surface and during printing on the second surface, soiling of the recording material occurs. In the first embodiment, since the potential difference is smaller during printing on the second surface than during printing on the first surface by 350 V, neither soiling of the conveyance guide 50 nor soiling of the recording material P occur.

As described above, soiling of the conveyance guide 50 is prevented while preventing a leakage of a current from the transfer roller 5 by setting a potential difference between the surface potential of the photoconductive drum 1 charged by the charging roller 2 and the potential of the conveyance guide 50 to be smaller during printing on the second surface than during printing on the first surface. Although soiling of the conveyance guide 50 can be prevented when the potential difference during printing on the second surface is reduced to 750 V in the present embodiment, an appropriate value for the potential difference may be determined depending on a configuration of the apparatus main body.

Although both the surface potential of the photoconductive drum 1 charged by the charging roller 2 and the voltage applied to the conveyance guide 50 during printing on the first surface and during printing on the second surface are changed as a method for reducing the potential difference in the present embodiment, either of these voltages may be changed.

Although the voltage applied to the conveyance guide 50 from the auxiliary power source 50*a* during duplex image formation is turned off in the present embodiment, a voltage of negative polarity may be applied to the conveyance guide 50 from the auxiliary power source 50*a* in a range in which no leakage current occurs. In this case, it is possible to further reduce the amount of toner adhering to the conveyance guide 50.

Second Embodiment

In the first embodiment, a configuration in which a potential difference between the surface potential of the photoconductive drum 1 charged by the charging roller 2 and the potential of the conveyance guide 50 during duplex image formation is fixed regardless of a printing ratio during printing on the first surface is described. A second embodiment is a configuration in which a potential difference between a surface potential of a photoconductive drum 1 charged by a charging roller 2 and a potential of a conveyance guide 50 during duplex image formation is changed depending on a printing ratio of one image during printing on a first surface. Other configurations are the same as those of the image forming apparatus 100 according to the first embodiment, and are described with the same reference numerals.

As described above, obtaining desired transfer efficiency by flowing a current from the conveyance guide 50 to the photoconductive drum 1 through a recording material P is effective for a recording material P which has low resistance under a high-humidity environment etc. Since no current flows through a recording material P which has high resistance, such as a dried recording material P, application of a voltage to the conveyance guide 50 has a small influence on transfer efficiency to the recording material P. Even under a high-humidity environment, moisture content in the recording material P immediately after passing through the fixing process is evaporated with fixing heat, and the recording material P is dried temporarily. Therefore, even if no voltage is applied to the conveyance guide 50 during printing on a second surface during duplex printing, escape of a part of a transfer current through the recording material P can be prevented.

However, under a substantially high-humidity/high-temperature environment or if the recording material P is thick and moisture content is substantially high, there is a case where resistance of the recording material P does not become high enough in the fixing process during printing on the first surface and the recording material P still has low resistance during printing on the second surface. If toner is transferred and fixed densely during printing on the first surface, a surface of the recording material is covered with toner, and such a recording material has high surface resistance. Therefore, no transfer current escapes even under the high-humidity/high-temperature environment and if the recording material P has high moisture content as described above. If the printing ratio during printing on the first surface is low, an amount of toner itself is small, and toner during printing on the first surface does not easily deposit on the conveyance guide 50.

Then, in the present embodiment, a voltage applied to the conveyance guide 50 is changed depending on the printing ratio during printing on the first surface. Specifically, if the printing ratio during printing on the first surface is higher than a threshold, a potential difference between a surface potential of the photoconductive drum 1 charged by the charging roller 2 and a potential of the conveyance guide 50 is set to be smaller during printing on the second surface than during printing on the first surface. If the printing ratio during printing on the first surface is less than the threshold, a potential difference between the surface potential of the photoconductive drum 1 charged by the charging roller 2 and the potential of the conveyance guide 50 is set to be substantially the same.

In the present embodiment, since toner begins to deposit on the conveyance guide 50 when the printing ratio exceeds 9%, the printing ratio during printing on the first surface of 8% is defined as the threshold.

Figure 5:
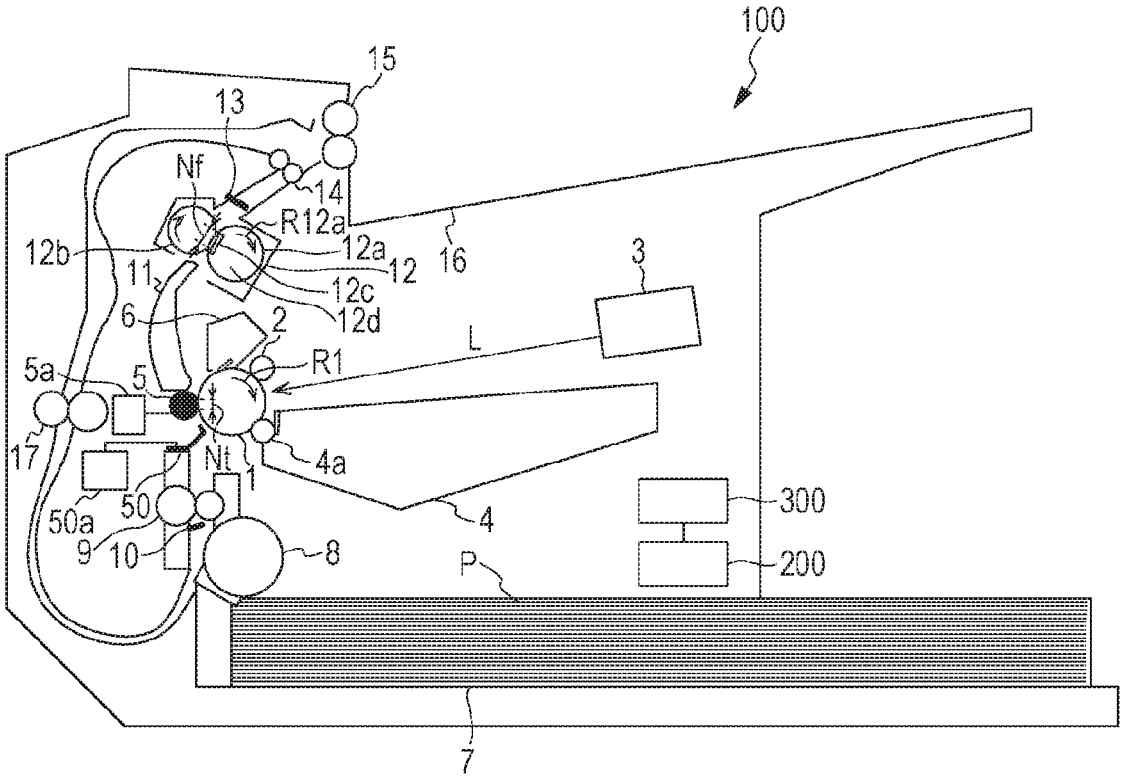
FIG. 5 is a schematic cross-sectional view of an image forming apparatus according to a second embodiment.

FIG. 5 schematically illustrates an image forming apparatus 100 provided with a printing ratio acquisition unit 300 in one image. According to the present embodiment, a CPU 200 controls a potential difference between Vd and the potential of the conveyance guide 50 during printing on the first surface and during printing on the second surface depending on the printing ratio during printing on the first surface obtained from the printing ratio acquisition unit 300. Specifically, if the printing ratio during printing on the first surface is less than 9%, the potential difference between Vd and the potential of the conveyance guide 50 is not changed during printing on the first surface and during printing on the second surface, and a voltage is applied to the conveyance guide 50 during printing also on the second surface, escape of a current through the recording material P can be prevented even if the recording material P of the second surface has low resistance. Further, since the printing ratio during printing on the first surface is less than 9%, substantially no toner is attracted to the conveyance guide 50, and the conveyance guide 50 is not soiled easily. If the printing ratio during printing on the first surface is equal to or greater than 9%, by setting the potential difference between Vd and the potential of the conveyance guide 50 to be smaller during printing on the second surface than during printing on the first surface by 350 V, a part of toner fixed to the recording material P is not attracted to the conveyance guide 50 due to an electric field. Therefore, deposition of toner can be prevented. Since printing is performed densely during printing on the first surface and the recording material P has high surface resistance, a leakage of the transfer current does not easily occur during printing on the second surface.

With this configuration, even during printing on the second surface or even if the recording material P has low resistance, it is possible to prevent deposition of toner on the conveyance guide 50, while preventing a leakage of the current from the transfer roller 5 through the recording material P.

Third Embodiment

In the first embodiment, a configuration in which a potential difference between the surface potential of the photoconductive drum 1 charged by the charging roller 2 and the potential of the conveyance guide 50 during duplex image formation is fixed regardless of an ambient environment of the image forming apparatus 100 is described. A third embodiment is a configuration in which a potential difference between a surface potential of a photoconductive drum 1 charged by a charging roller 2 and a potential of a conveyance guide 50 during duplex image formation is changed depending on an ambient environment. Other configurations are the same as those of the image forming apparatus 100 according to the first embodiment, and are described with the same reference numerals.

Under a low-humidity/low-temperature environment, generally the recording material P is dried and has high resistance, and toner has high triboelectricity. In that case, a part of toner fixed to the recording material P during duplex image formation is easily attracted to the conveyance guide 50, and toner easily deposits on the conveyance guide 50. Then, in the third embodiment, if a low-humidity/low-temperature environment is detected by an environment detection unit 400, a voltage of polarity opposite to a transfer voltage (in the present embodiment, negative) is applied to the conveyance guide 50 during printing on a second surface.

Figure 6:
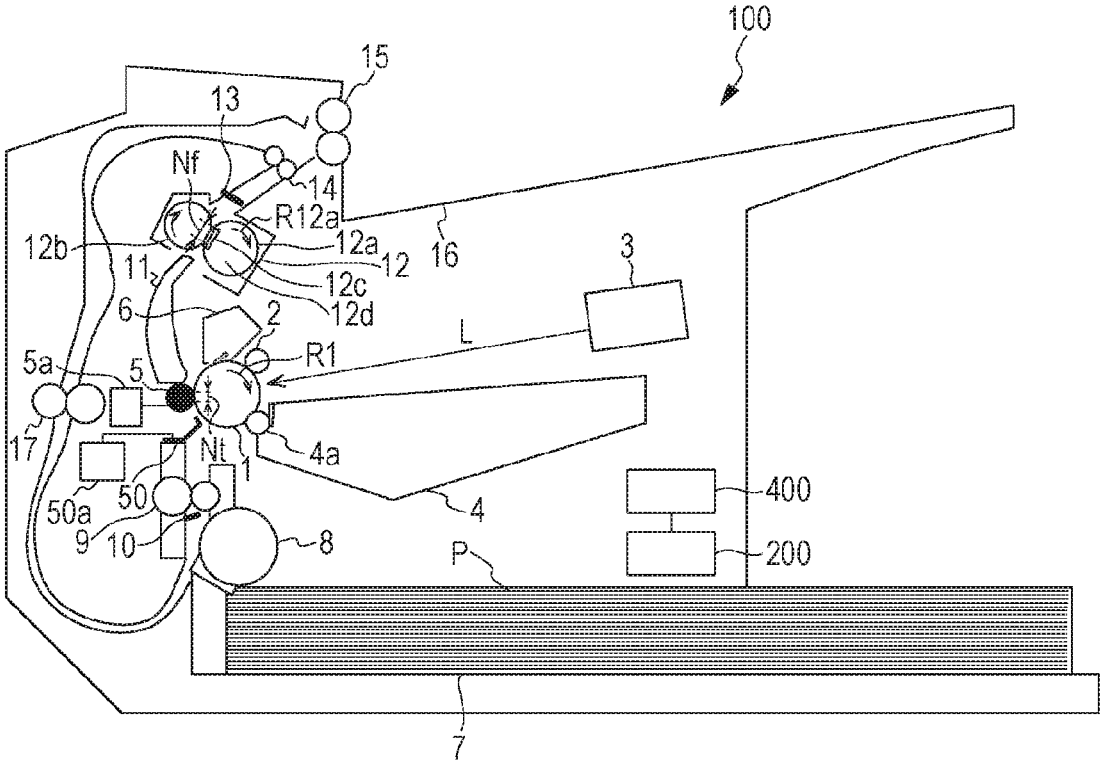
FIG. 6 is a schematic cross-sectional view of an image forming apparatus according to a third embodiment.

FIG. 6 schematically illustrates an image forming apparatus 100 provided with the environment detection unit 400. The image forming apparatus 100 according to the third embodiment is the same as the image forming apparatus 100 according to the first embodiment in configuration and control except that the environment detection unit 400 is provided and that an auxiliary power source 50*a* can apply a voltage of negative polarity to the conveyance guide 50. The same configuration and control are not described. A publicly known device may be used as the environment detection unit 400.

If the environment detection unit 400 detects a low-humidity/low-temperature environment (in the present embodiment, 15° C. or below and 10% or below), a voltage of negative polarity (in the present embodiment, −300 V) is applied to the conveyance guide 50 from the auxiliary power source 50*a* during printing on a second surface. With this configuration, even if the recording material P has high resistance depending on the environment and toner has high triboelectricity, a part of toner fixed to the recording material P on a first surface is not attracted to the conveyance guide 50. The recording material P after the toner is fixed to the first surface under the low-humidity/low-temperature environment has high resistance, and a part of a transfer current does not escape through the recording material P.

With this configuration, even if toner has high triboelectricity, toner deposition on the conveyance guide 50 can be prevented, while preventing a leakage of a current from the transfer roller 5 through the recording material P.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-109284 filed May 31, 2016, which is hereby incorporated by reference herein in its entirety.

What is claimed is:

1. An image forming apparatus, comprising:

a photoconductor on which an electrostatic latent image is formed;

a charging member configured to charge the photoconductor;

a developing member configured to develop the electrostatic latent image formed on the photoconductor with toner charged to predetermined polarity;

a transfer member configured to form a transfer portion together with the photoconductor and to transfer a toner image from the photoconductor to a recording material in the transfer portion;

a transfer power source configured to apply a voltage of polarity opposite to the predetermined polarity to the transfer member;

a guidance member provided upstream of the transfer portion in a conveyance direction of the recording material, and configured to guide the recording material in contact with a back surface of the conveyed recording material, wherein the recording material guided to the photoconductor by the guidance member is conveyed to the transfer portion in contact with the photoconductor from the upstream of the transfer portion in the conveyance direction of the recording material;

an auxiliary power source configured to apply a voltage of the opposite polarity to the guidance member;

a fixing unit configured to fix the toner image transferred from the photoconductor to the recording material; and a control unit configured to control a potential difference between a surface potential of the photoconductor charged by the charging member and a potential of the guidance member, wherein the image forming apparatus is capable of performing duplex image formation by turning over the recording material in which the toner image is fixed to a first surface by the fixing unit, conveying the recording material to the transfer portion, and transferring the toner image from the photoconductor to a second surface, and wherein when performing the duplex image formation, the control unit controls a potential difference between a surface potential of the photoconductor charged by the charging member and a potential of the guidance member to be smaller during printing on the second surface than during printing on the first surface.

2. The image forming apparatus according to claim 1, wherein the control unit controls the voltage applied by the auxiliary power source, and wherein the control unit controls the voltage applied to the guidance member by the auxiliary power source to be smaller during printing on the second surface than during printing on the first surface.

3. The image forming apparatus according to claim 1, wherein the control unit controls the charging member, and wherein the control unit controls the surface potential of the photoconductor charged by the charging member to be smaller during printing on the second surface than during printing on the first surface.

4. The image forming apparatus according to claim 1, further comprising a conveyance unit disposed upstream of the guidance member in the conveyance direction of the recording material and configured to convey the recording material pinched in a conveyance portion toward the transfer portion.

5. The image forming apparatus according to claim 4, wherein a part of the guidance member protrudes toward the photoconductor over a line connecting the transfer portion and the conveyance unit.

6. The image forming apparatus according to claim 5, wherein the guidance member includes an opposed surface at a position facing the photoconductor.

7. The image forming apparatus according to claim 5, wherein the guidance member is disposed at a position closer to the transfer portion than the conveyance unit in the conveyance direction of the recording material.

8. The image forming apparatus according to claim 1, wherein the control unit controls the voltage applied to the guidance member by the auxiliary power source during printing on the first surface when performing the duplex image formation to be a voltage of the same polarity as and is smaller in an absolute value than the voltage applied to the transfer member by the transfer power source.

9. The image forming apparatus according to claim 8, wherein the control unit stops application of the voltage to the guidance member by the auxiliary power source during printing on the second surface when performing the duplex image formation.

10. The image forming apparatus according to claim 1, wherein the auxiliary power source is capable of applying a voltage of polarity opposite to the predetermined polarity to the guidance member, a voltage applied to the guidance member by the auxiliary power source during printing on the first surface when performing the duplex image formation is a voltage of opposite polarity, and a voltage applied to the guidance member by the auxiliary power source during printing on the second surface when performing the duplex image formation is a voltage of the same polarity.

11. The image forming apparatus according to claim 1, wherein the control unit controls a potential difference between a surface potential of the photoconductor charged by the charging member and a potential of the guidance member to be smaller during printing on the second surface than during printing on the first surface depending on a printing ratio in one image transferred to the recording material.

* * * * *